United States Patent [19]

Hertweck et al.

[11] Patent Number: 4,969,445

[45] Date of Patent: Nov. 13, 1990

[54] DEVICE FOR EXHAUST GAS RECIRCULATION ON A MULTI-CYLINDER DIESEL INTERNAL COMBUSTION ENGINE

[75] Inventors: Gernot Hertweck, Fellbach; Christian Enderle, Esslingen, both of Fed. Rep. of Germany

[73] Assignee: Daimler-Benz Aktiengesellschaft, Stuttgart, Fed. Rep. of Germany

[21] Appl. No.: 414,279

[22] Filed: Sep. 29, 1989

[30] Foreign Application Priority Data

Oct. 28, 1988 [DE] Fed. Rep. of Germany ..... 3836723

[51] Int. Cl.[5] ..... F02M 25/07

[52] U.S. Cl. ..... 123/569; 123/568

[58] Field of Search ..... 123/198 F, 568, 569, 123/570, 571

[56] References Cited

U.S. PATENT DOCUMENTS

| | | | |
|---|---|---|---|
| 3,542,004 | 11/1970 | Cornelius | 123/568 |
| 4,296,724 | 10/1981 | Iizuka et al. | 123/568 |
| 4,303,053 | 12/1981 | Etoh et al. | 123/568 |
| 4,304,208 | 12/1981 | Etoh et al. | 123/568 |
| 4,484,440 | 11/1984 | Oki et al. | 60/276 |

FOREIGN PATENT DOCUMENTS

| | | | |
|---|---|---|---|
| 2946017 | 6/1980 | Fed. Rep. of Germany . | |
| 3010787 | 10/1982 | Fed. Rep. of Germany . | |
| 3022959 | 8/1985 | Fed. Rep. of Germany . | |
| 0041944 | 2/1987 | Japan | 123/568 |

*Primary Examiner*—Willis R. Wolfe

*Attorney, Agent, or Firm*—Evenson, Wands, Edwards, Lenahan & McKeown

[57] ABSTRACT

A device for the exhaust gas recirculation on a multi-cylinder diesel internal combustion engine with exhaust manifolds assigned to cylinder groups has manifold parts integrally combined into a twin branch with a common partition wall separating the flows of the two exhaust manifolds, in which partition wall an opening is provided, via which the manifold parts of the two exhaust manifolds are in connection with the exhasut recirculation pipe.

8 Claims, 1 Drawing Sheet

DEVICE FOR EXHAUST GAS RECIRCULATION ON A MULTI-CYLINDER DIESEL INTERNAL COMBUSTION ENGINE

BACKGROUND AND SUMMARY OF THE INVENTION

The invention generally relates to a device for exhaust gas circulation on a multi-cylinder diesel internal combustion engine, and more particularly to such a device for a twin flow exhaust manifold arrangement.

Published Unexamined Patent Application (DE-OS) No. 2,946,017 discloses the provision of a twin flow exhaust manifold arrangement wherein the exhaust recirculation pipe containing the exhaust recirculation valve branches off from one of the two exhaust manifolds assigned to cylinder groups. Such a design suffers from the disadvantage that intended $N0_x$ limit values cannot be maintained, since only a part of the total exhaust gas stream is used for the recirculated quantity of exhaust gas.

An object of the present invention is to provide a device for a twin flow exhaust manifold arrangement by which recirculated quantities of exhaust gas can be taken from the total exhaust gas stream with little constructional expenditure and without additional space requirement.

By the measures according to preferred embodiments of the present invention, recirculated exhaust gas is taken in equal parts from both of the flows of the exhaust manifold arrangement, it being possible in a simple way to restore the separate twin flow capability with stopping of the exhaust gas recirculation.

Although the taking of recirculated exhaust gas from both of the flows of the exhaust manifold arrangement is disclosed by DE No. 30 22 959 C 2, a considerable constructional expenditure is involved here, since a separate exhaust recirculation pipe branches from each exhaust manifold, with a control valve in each case for the exhaust gas recirculation rate.

Other objects, advantages and novel features of the present invention will become apparent from the following detailed description of the invention when considered in conjunction with the accompanying drawings.

DETAILED DESCRIPTION OF THE DRAWINGS

Figure 1:
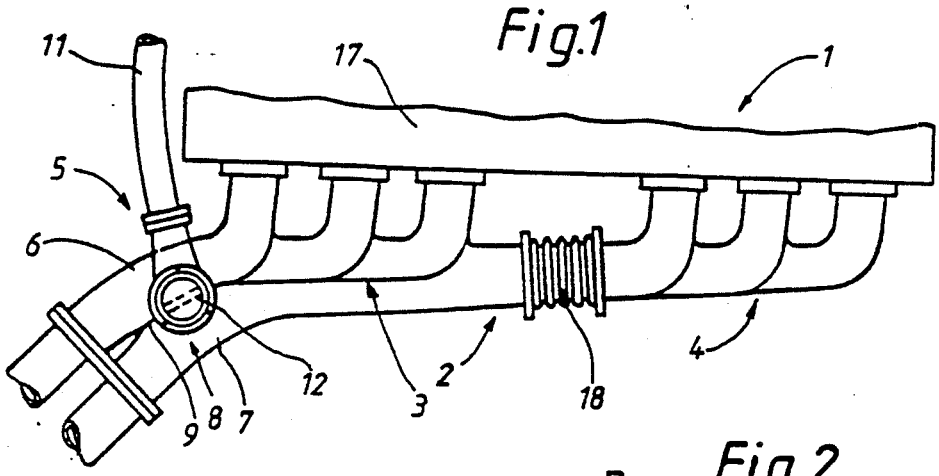
FIG. 1 shows the device according to one embodiment of the present invention on an exhaust manifold arrangement having two exhaust manifolds.
Figure 4:
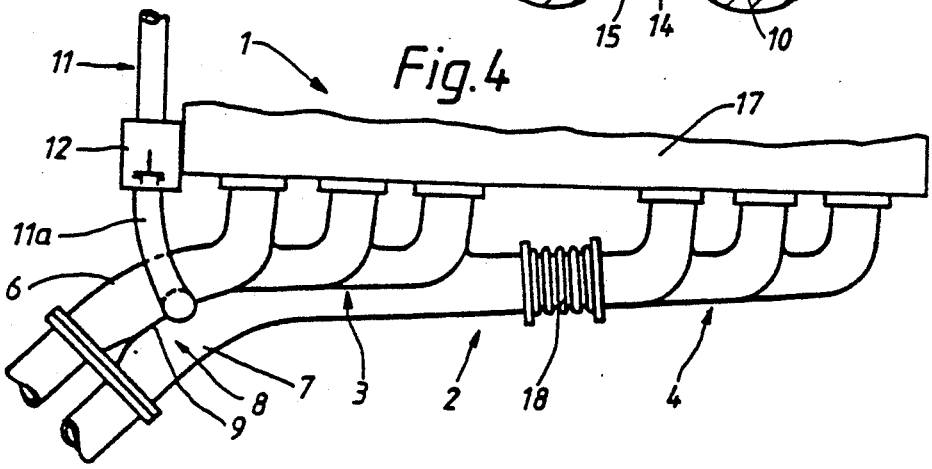
FIG. 4 shows a further exemplary embodiment of the device according to the invention.

In FIGS. 1 and 4, a diesel internal combustion engine 1 of in line design with a twin flow exhaust manifold arrangement 2 is shown, which includes two exhaust manifolds 3, 4, assigned to cylinder groups, with a device 5 for the recirculation of the exhaust gases into an intake pipe (not shown).

Manifold parts 6, 7 of the exhaust manifolds 3, 4 are integrally combined in the area of the exhaust gas recirculation into a twin branch 8. The partition or separating wall 9 of the twin branch 8, separating the two flows, is provided with an opening 10, through which the exhaust gases can be fed through an exhaust recirculation pipe 11 of the intake pipe.

Figure 2:
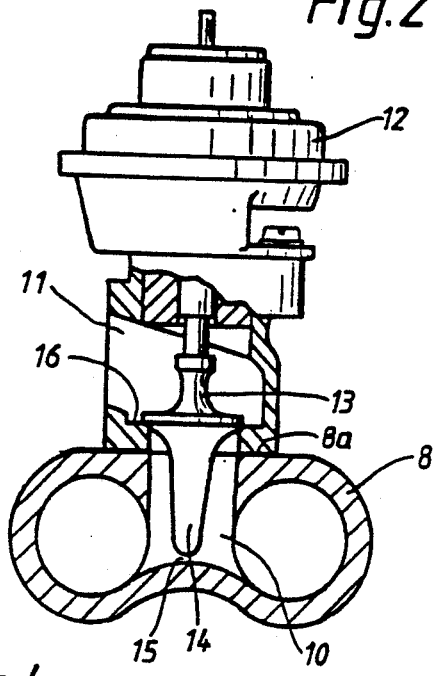
FIG. 2 shows the device of FIG. 1 on an enlarged scale.
Figure 3:
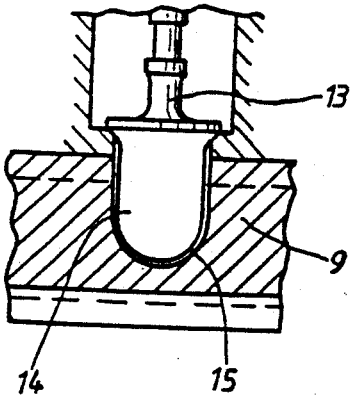
FIG. 3 shows the device of FIG. 2 in section along the line III—III in FIG. 2.

The exhaust recirculation pipe 11 is centrally flange mounted on a web 8*a*, connecting the two branches of the twin branch 8 (FIGS. 1 and 2), and contains controllable exhaust recirculation valve 12 with a valve disk 13, a side of which facing the twin branch 8 has a plate shaped separating wall part 14 which, in the closed position of the valve 12, fills the opening 10 virtually completely. The separating wall part 14 protruding into the opening 10 has an approximately semicircular shape (FIG. 3) and, according to FIG. 2, separates the two flows in the twin branch 8 apart from a minimal gap 15, in order to ensure a secure sealing of the valve disk 13 on its valve seat 16.

Consequently, by the coupled design of the valve disk 13 with the separating wall part 14, both the exhaust gas flow via the exhaust recirculation pipe 11 to the intake pipe is completely stopped and the separate twin flow capability is retained virtually completely. The charge cycle in operation close to full load, that is without exhaust gas recirculation, can take place unhindered via both flows.

In the case of the design according to FIG. 4, the exhaust recirculation valve 12 is arranged away from the exhaust manifold, namely flange mounted downstream of a pipe section 11*a* of the exhaust recirculation pipe 11 on the cylinder head 17 of the internal combustion engine. Due to the remote position of the temperature sensitive exhaust recirculation valve 12, the latter is subjected to substantially less heat loading and heat-insulating measures are not necessary, although the twin flow capability is slightly disturbed on account of the absence of a control member in the separating wall 9 of the twin branch 8, since the two flows are not completely separated from each other.

The exhaust manifolds 3, 4, assigned to the cylinder groups and lying one behind the other, are connected to each other by a flexible expander 18, in order to counteract heat stresses occurring between the varyingly long exhaust manifolds.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Device for exhaust gas recirculation on a multi-cylinder diesel internal combustion engine with exhaust manifolds assigned to cylinder groups comprising:

manifold parts integrally combined into a twin branch with a common partition wall separating flows of the exhaust manifolds;

an exhaust recirculation pipe leading from the manifold parts to an intake pipe; and an exhaust recirculation valve controlling an exhaust gas recirculation rate as a function of operating parameters of the internal combustion engine, the common partition wall between the manifold parts having an opening via which through actuation of the exhaust recirculation valve the manifold parts are in fluid connection with the exhaust recirculation pipe for controlling the rate.

2. Device for exhaust gas recirculation on a multi-cylinder diesel internal combustion engine with exhaust manifolds assigned to cylinder groups comprising:

manifold parts integrally combined into a twin branch with a common partition wall separating flows of the exhaust manifolds;

and exhaust recirculation pipe leading from the manifold parts to an intake pipe; and an exhaust recirculation valve controlling an exhaust gas recirculation rate as a function of operating parameters of the internal combustion engine, the common partition wall between the manifold parts having an opening via which the manifold parts are in fluid connection with the exhaust recirculation pipe, wherein a partition wall part, which is controllable and coupled to the exhaust recirculation valve, is arranged in the opening.

3. Device according to claim 2, wherein the exhaust recirculation valve has a valve disk, which, in the closed position, is firmly connected to the partition wall part, and seals off a valve seat, while the partition wall part separates the manifold parts apart from a minimal gap.

4. Device according to claim 1, wherein the exhaust recirculation valve is fitted in the exhaust recirculation pipe in a region remote from the exhaust manifold.

5. A device for exhaust gas recirculation in a multi-cylinder internal-combustion engine, particularly a diesel internal-combustion engine, comprising exhaust manifolds assigned to cylinder groups, with manifold parts integrally combined with a twin branch having a common partition wall separating flows of the two exhaust manifolds and being provided with an opening, exhaust recirculation pipe leading to an intake pipe, and an exhaust recirculation valve controlling the exhaust gas recirculation rate as a function of operating parameters of the internal-combustion engine, wherein the exhaust recirculation pipe originates from the opening arranged in the common partition wall of the two manifold parts.

6. The device according to claim 5, wherein a partition wall part, which is controllable and coupled to the exhaust recirculation valve, is arranged in the opening.

7. The device according to claim 6, wherein the exhaust recirculation valve has a valve disk, which, in the closed position, is firmly connected to the partition wall part, and seals off a valve seat, while the partition wall part separates the manifold parts apart from a minimal gap.

8. The device according to claim 5, wherein the exhaust recirculation valve is fitted in the exhaust recirculation pipe in a region remote from the exhaust manifold.

* * * * *